US005086416A

United States Patent [19]

Dubois et al.

[11] Patent Number: 5,086,416

[45] Date of Patent: Feb. 4, 1992

[54] DISPLAY MODULE FOR WATCH MOVEMENT

[75] Inventors: Gérald Dubois; Francois Berthoud, both of Le Lieu, Switzerland

[73] Assignee: Dubois & Depraz S.A., Le Lieu, Switzerland

[21] Appl. No.: 507,188

[22] Filed: Apr. 10, 1990

[30] Foreign Application Priority Data

Apr. 14, 1989 [CH] Switzerland ..... 1432/89

[51] Int. Cl.[5] ..... G04B 19/26

[52] U.S. Cl. ..... 368/18; 368/19; 368/28

[58] Field of Search ..... 368/15–20

[56] References Cited

U.S. PATENT DOCUMENTS

| | | | |
|---|---|---|---|
| 2,677,928 | 5/1954 | Haynes | 368/19 |
| 3,524,313 | 8/1970 | Wood | 58/3 |
| 3,708,971 | 1/1973 | Wlodyka | 368/19 |
| 3,745,313 | 7/1973 | Spichaus | 368/19 |
| 3,921,383 | 11/1975 | Leone | 368/19 |
| 3,982,104 | 9/1976 | Banner | 58/3 |
| 4,632,259 | 11/1986 | Oberst | 368/19 |
| 4,853,908 | 8/1989 | Bourguin et al. | 368/19 |

FOREIGN PATENT DOCUMENTS

| | | |
|---|---|---|
| 2454761 | 5/1976 | Fed. Rep. of Germany . |
| 8610798H | 7/1986 | Fed. Rep. of Germany . |
| 2280120 | 2/1976 | France . |
| 2500181 | 8/1982 | France . |
| 278335 | 1/1952 | Switzerland . |

*Primary Examiner*—Vit W. Miska
*Attorney, Agent, or Firm*—Young & Thompson

[57] ABSTRACT

A dial 1 provided with an hour graduation 2 cooperating with hands 3, 4, 5, intended to be driven by the hand setting of a movement on which the module can be fixed. This dial 1 comprises further a circular twenty-four hours graduation 11 cooperating simultaneously on the one hand with a hand 13 driven in rotation by a mechanism of the module at a speed of one complete revolution per twenty-four hours and on the other hand a tides disc 12 driven in rotation by the mechanism of the module at a speed of one complete turn for each moon cycle.

15 Claims, 3 Drawing Sheets

DISPLAY MODULE FOR WATCH MOVEMENT

The present invention relates to an play module comprising a dial provided with a time graduation and its hands for the display of the time.

This module comprises further a display indicating the high and low tides. It can according to the variants, also comprise a day of the week display, a date display and a lunar phases display. This display module comprises a driving mechanism of the different displays it presents from a force drive of a watch movement on which it is fixed. This force drive can be constituted by the hours wheel or an extension of it of a watch movement which makes one complete turn in twelve hours. The watch movement provided with the present display module can be a mechanical movement, which can be automatic or not, or an electromechanic movement or a quartz movement.

This display module comprises an analogical indication of the tides and is more particularly intended to equip watches for sailors, sportsmen, fishermen, divers in a general way watches intended for mariners.

The analogical display module distinguishes itself by the caracteristics described and claimed in the following.

The attached drawings show schematically and by way of example three embodiments of the display module according to the present invention.

Figure 1:
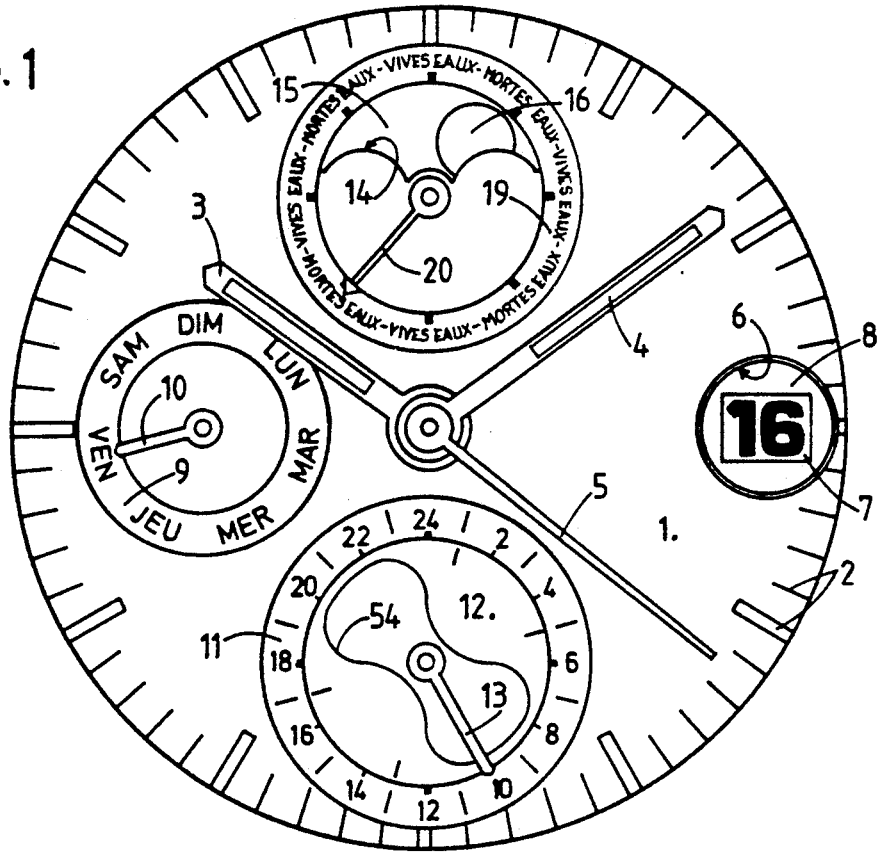
FIG. 1 is a top view of the first embodiment of the display module.
Figure 7:
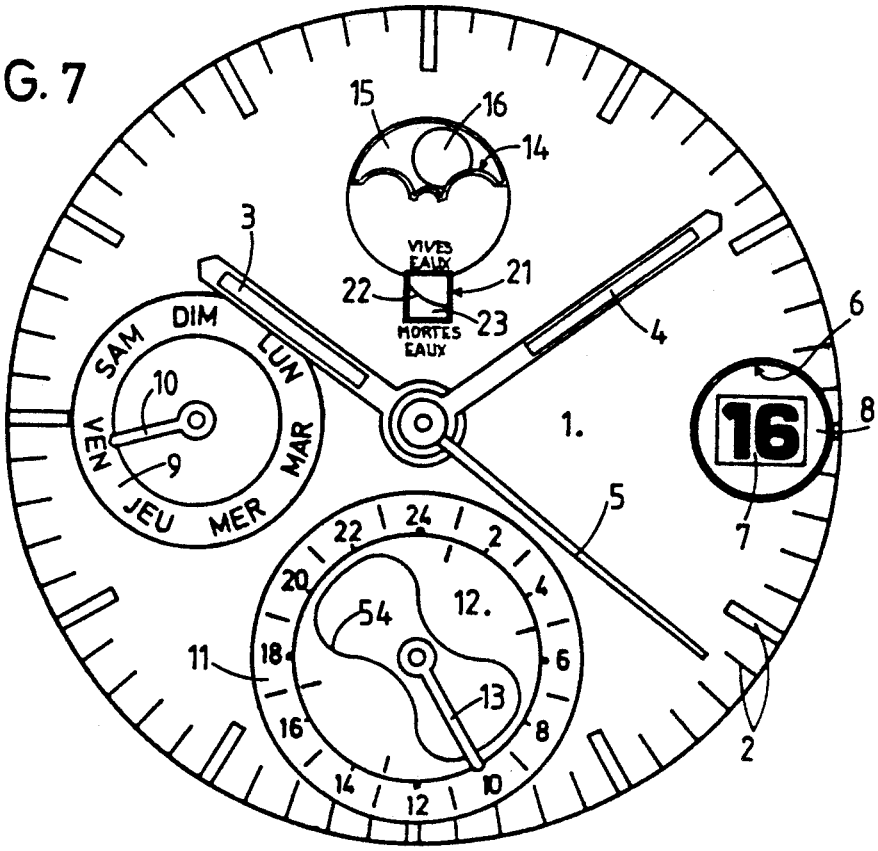
FIG. 7 is a top view of the third embodiment of the display module.

In each of the three embodiments of the display module (FIGS. 1, 2 and 7) which comprises a dial 1 provided at its periphery with an hour graduation 2 intended to cooperate with the hours hands 3, the minutes hands 4, and the seconds hands 5, of the hand setting. The dial 1 is provided with an aperture or windows 6 located above an aperture 7 provided in the base plate 8 of the module permitting thus to see a date indication carried by the date crown of the watch movement (not shown) on which the module is fastened.

In its three embodiments, the display module comprises further a day of the week display comprising a graduation 9 and a hand 10 located between the center of the hand setting and nine o'clock, as well as a tides display located between the center of the hand setting and six o'clock, comprising a graduation of twenty-four hours 11, a display disc 12 of the high and low tides as well as a hand 13.

The display module comprises further a display of the moon phases formed, in the first and third embodiments, by a cut-out 14 of the dial 1 having the heaven shape and a moon disc 15 comprising the representations of the moon 16 and in the second embodiment through a small dial 17 carrying the representations of the full moon and new moon and of the waxing and waning moon.

The analogic display module comprises finally a display of the high tide and low tide formed, in the first and second embodiments, through a graduation 19 of the dial, surrounding the display of the phases of the moon, cooperating with a hand 20, and in the third embodiment through a window 21 provided in the dial 1, through which one can see a curve 22 carried by a ring 23 being part of the moon disc 15.

The displays for the phases of the moon and the high and low tides are located between the center of the hand setting and twelve o'clock.

The mechanism of the analogical display module, permitting to drive all the movable organs, of the different displays described hereabove, driven by the force drive, here the minutes wheel (not shown) of the watch movement of which the module is fastened, is shown in FIGS. 3 to 6.

The seconds hand 5 fastened to the shaft 24 and the minutes hand 4 fastened with a shaft 25 concentric to the shaft 24 are actuated by a conventional hand setting of the watch movement through the hours wheel 26 carrying rigidly fixed at its lower part a pinion 28. This hours wheel 26 crosses the base plate 8 of the module through a passage 27 of it. The pinion 28 is meshing simultaneously with three identical movable members 29, 30 and 31 pivoted around the shafts 32, 33 and 34 respectively, fastened to the base plate 8 and located at the apices of a triangle surrounding the shaft of the pinion 28. In the example shown the pinion 28 comprises twenty-five teeth and each of the movable members 29, 30 and 31 comprises fifty teeth so that each of them makes one complete revolution in twenty-four hours. Each of the movable members 29, 30 and 31 comprises a slot 35.

A hub 36 (FIG. 3) pivoted idly on the shaft 32 carries a movable member 37 having one tooth 38. This movable member 37 comprises a pin 39 extending into the slot 35 of the movable member 29; it is thus driven at the speed of one turn per day, this pin 39 being in contact with the end of the slot 35. The tooth 38 of the movable member 37 actuates a star having seven teeth 40 pivoted on a shaft 41 driven into the base plate 8. This star 40 carries the hand 10 of the display of the day of the week.

The seven teeth star 40 is subjected to the action of a spring 42 maintaining its angular position between two successive drives through the movable member 37. This spring 42 is fastened to the base plate 8.

Figure 2:
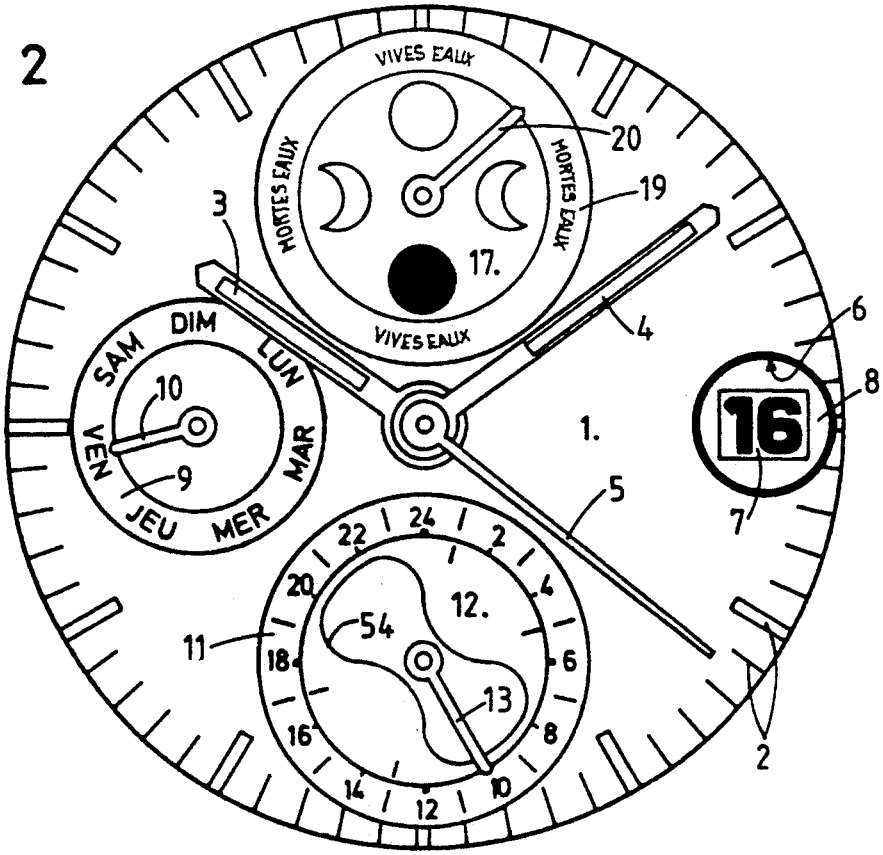
FIG. 2 is a top view of the second embodiment of the display module.
Figure 3:
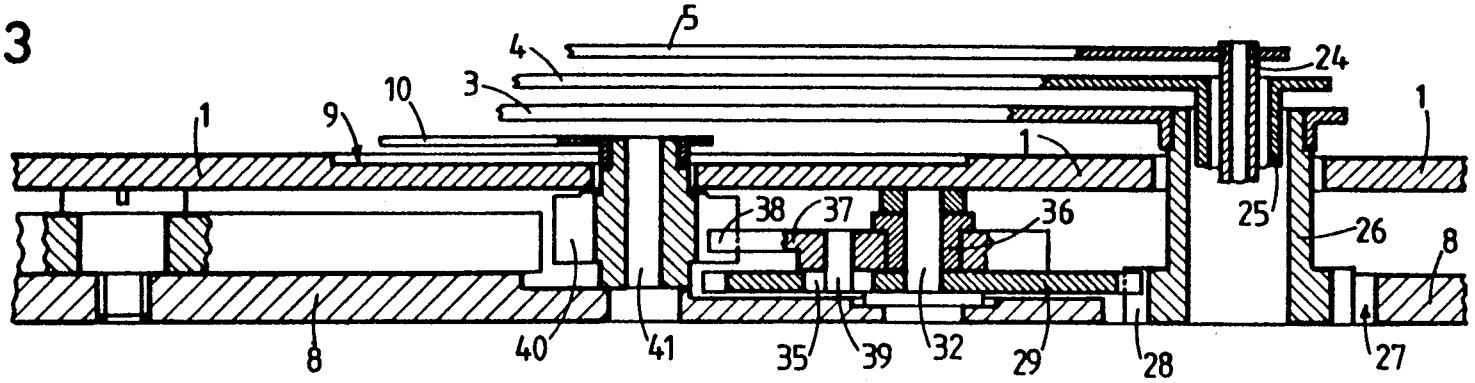
FIGS. 3 and 4 are crossections, which partially overlap along a line A—A of FIG. 6.
Figure 4:
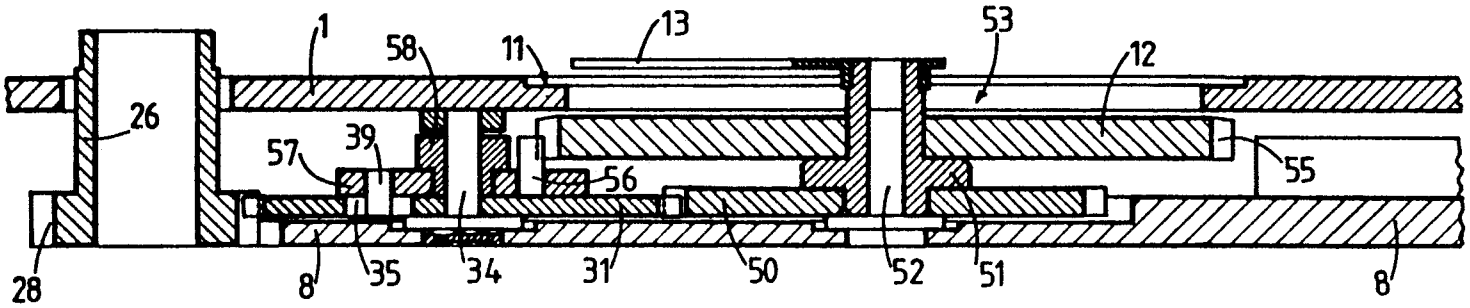
Figure 5:
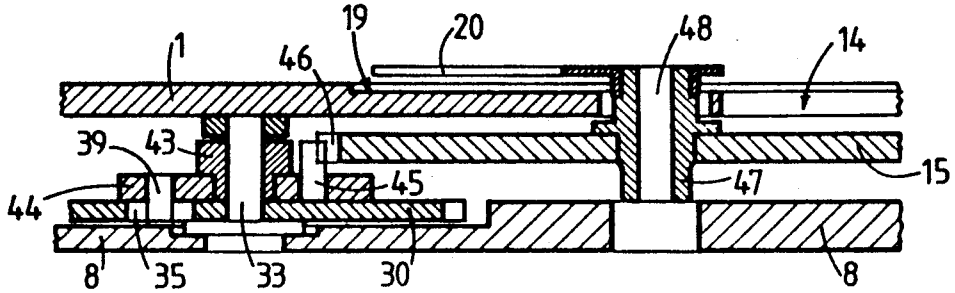
FIG. 5 is a crossection along line B—B of FIG. 6.
Figure 6:
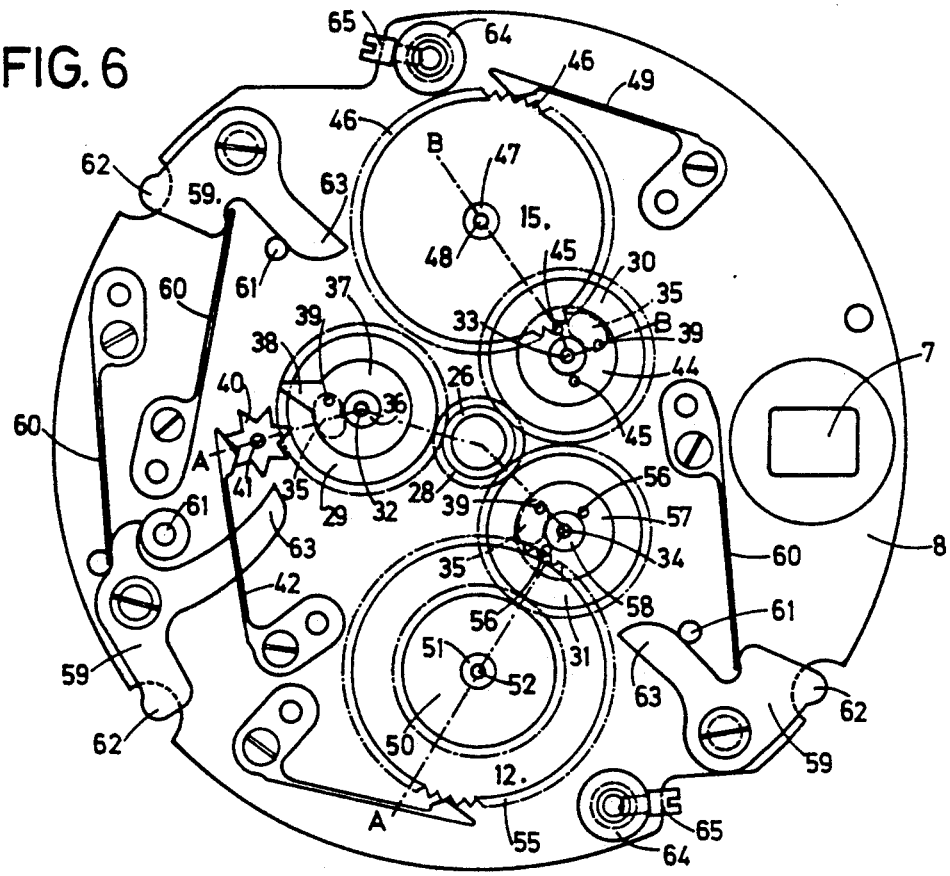
FIG. 6 is a top view of the driving mecanism of the display module, the hands and the dial being taken away.

A hub 43 (FIG. 5) is idly pivoted on a shaft 33 concentric to the movable member 30 and carries a disc 44 provided with a pin 39 cooperating for its driving together with the slot 35 of the movable member 30. This disc 44 comprises a finger 45 cooperating with a peripheral toothing 46 having fifty-nine teeth of the disc 15 for the embodiments of FIGS. 1 and 7 (1 turn=2 moon periods=59 days), or two fingers 45 cooperating with a peripheral toothing 46 having fifty-nine teeth of the disc 15, respectively of the hand 20 for the embodiment of FIG. 2 (1 turn in one moon period=29.5 days) of the display of the phases of the moon, fastened to the hub 47 pivoted on a shaft 48 driven into the base plate 8. The upper face of the moon disc, making one complete revolution in 29.5 days, carries representations of the moon 16 and is visible through the aperture 14 (FIGS. 1 and 7) respectively the hand 20 on the dial 17 (FIG. 2). A spring 49 fastened to the base plate 8 maintains the angular position of the moon disc 15 between two successive drivings.

The upper end of the hub 47 carries the hand 20 of the display of the high and low tides. Four complete cycles of tides amplitudes, high tide - low tide - high tide, are comprised in one moon period or synodical revolution of 29.5 days, these four cycles appear on the circular graduation 19 surrounding the display of the moon phases 14, 15, 16 and the hand 20 driven by the moon disc 15 cooperates with this graduation 19.

The movable member 31 (FIG. 4), driven by the pinion 28 meshes with a secondary movable member 50 having an equal number of teeth, that is fifty in the example shown, is fastened to a hub 51 pivoted on a shaft 52 driven in the base plate 8. The upper end of this hub 51 carries the hand 13 cooperating with the twenty-four hours graduation 11 which is concentric to the tides display. This hand 13 indicating twenty-four hours is always synchronised with the hours hand 3.

The central portion of the hub 51 is used as pivot for the tides disc 12 which is visible through the aperture 53 of the dial and the upper face of which presents a curve 54 forming two opposed lobes indicating two high tides respectively low tides.

The tides disc 12 comprises a peripheral toothing 55 having fifty-nine teeth. This disc 12 is driven in a similar way as the moon disc 15, by means of two fingers 56 carried by a disc 57 fastened to the hub 58 pivoted on the shaft of the movable member 31. This disc 57 is driven in rotation by means of a pin 39 extending in the slot 35 of the movable member 31.

This tides disc 12 makes thus one complete rotation during a moon cycle that is in 29.5 days, and thanks to the relative position of the curve 54 with respect to the hand 13 of the graduation 11, the user can know at which hours of the day the high tide respectively the low tide will take place.

What is particularly interesting, is that the same graduation 11 enables to user to know the hour of the day thanks to the hand 13. Thus at a same glance the user can appreciate the time interval to run before the next high or low tide without being obliged to look at the normal hour display of the watch.

This combination of the concentric display on the same graduation 11 of the dial 1 on the one hand of the hour of the day by means of the hand 13 and of the high and low tides hours of the same day through the curve 54, is particularly original and useful for the user.

To be complete it is further to be noted that the display of the day of the week, the display of the moon phases and the display of the tides comprise manual actuation systems to actuate step by step the star with seven teeth 40, the moon disc 15 and the tides disc 12 respectively.

Each of these manual actuating systems comprises a lever 59 pivoted on the base plate 8, subjected to the action of a spring blade 60 tending to maintain it in rest position defined by the entering in to contact of a portion of this lever with an abutment 61. Each of these levers 59 comprises a push member 62 accessible from the periphery of the module and an actuating beak 63 cooperating respectively with the teeth of the star 40, the toothing 46 of the moon disc 15 and the toothing of tides disc 12.

The displacement step by step of the star 40, of the moon disc 15 and of the tides disc 12 caused by the said manual actuating systems has no influence on the working of the rest of the mechanism and thus on the movement thanks to the lost motion in the different kinematic linkages through the slot 35 and the pins 39.

In the third embodiment the display module which does not comprise the hand 20, the opening of the dial 14 in the shape of the heaven is smaller, so that a free ring 23 is left on the outside of the moon disc 15, the said ring carrying an undulating line 22 appearing in the window 21 and indicating through its height the high and low tides.

To ensure its fixation to the movement, the base plate 8 comprises two sockets 64 in which fixation feet of the movement can be introduced and locked by means of screws 65.

We claim:

1. Analogic display module comprising a dial provided with an hour graduation cooperating with hands intended to be driven by a movement on which the module can be fixed, said dial comprising further a circular graduation of twenty-four hours having a hand adapted to be driven in rotation by a said movement at a speed of one revolution per twenty-four hours and circumscribing a tides disc adapted to be driven in rotation by a said movement at a speed of one revolution for each moon cycle, said module further comprising a base plate carrying said dial and a sleeve adapted to be driven by a said movement at a speed of one turn per twelve hours, said sleeve having a pinion meshing with a movable member having a slot in which a pin is located, said pin being secured to a disc pivoted concentrically on said movable member, the last-named disc comprising at least one finger engaging with a toothing carried by the tides disc, and said movable member meshing also with a secondary movable member secured to said hand.

2. Module according to claim 1, wherein said movable member has the same number of teeth as said secondary movable member, these two movable members having a number of teeth equal to twice that of the toothing of the pinion of the sleeve carrying the hours hand, there being two said fingers.

3. Module according to claim 2, wherein said pinion of the sleeve comprises twenty-five teeth and the two movable members fifty teeth, the toothing of the tides disc comprising fifty-nine teeth.

4. Module according to claim 1, wherein an angular position of the tides disc is maintained between two successive actuations of the tides disc by a spring, the module comprising also a manual step-by-step actuating device for the tides disc.

5. Module according to claim 1, comprising further a display of the moon phases and a display of high waters and of low waters.

6. Module according to claim 5, the display of high waters and of low waters being concentric to the display of the moon phases.

7. Module according to claim 5, comprising also a second movable member meshing with the pinion of the sleeve presenting a slot in which a pin is located, said pin being fastened to a second disc pivoted concentrically to the said second movable member, the latter disc comprising at least on finger engaging with a toothing carried by a disc of moon phases, one part of said disc of moon phases at least being visible through an aperture of the dial and the upper surface of which displays at least one representation of the moon.

8. Module according to claim 7, wherein the moon phases disc is secured to a hand cooperating with a graduation of the high tide and low tide display through the dial.

9. Module according to claim 8, wherein the second movable member comprises fifty teeth, the second disc comprises at least one finger and the toothing of the disc of the moon phases comprises fifty-nine teeth.

10. Module according to claim 7, wherein the angular position of the disc of the moon phases is maintained between two successive actuations by a spring and the mechanism comprises a manual step-by-step actuating device of the moon phases disc.

11. Module according to claim 1, comprising also a display for the day of the week.

12. Module according to claim 11, comprising also a third movable member meshing with the pinion of the sleeve of which the number of teeth is equal to twice that of said pinion and having a slot in which a pin is located, which pin is fastened to a third disc pivoted concentrically to the said movable member, this third disc comprising one tooth cooperating with a star having seven teeth driving a hand cooperating with a graduation of the dial indicating the days of the week.

13. Module according to claim 12, wherein the third movable member comprises a toothing having fifty teeth.

14. Module according to claim 12, wherein the angular position of the star with seven teeth is maintained between two successive actuations by means of a spring, and a manual step-by-step actuating device for the star having seven teeth.

15. Module according to claim 1, wherein the dial comprises a window and the base plate comprises an opening, aligned with that window permitting a user to see the indication of the date on which the movement was set.

* * * * *